US005424708A

United States Patent [19]

Ballesty et al.

[11] Patent Number: 5,424,708

[45] Date of Patent: Jun. 13, 1995

[54] SYSTEM AND METHOD FOR TRANSFERRING HUB ALARM SERVICE MONITORING

[75] Inventors: Carol D. Ballesty, Irvine, Calif.; Paul R. Knirk, Tustin; Barry R. Mumm, Minnetonka, both of Minn.

[73] Assignee: Honeywell Inc., Minneapolis, Minn.

[21] Appl. No.: 990,232

[22] Filed: Dec. 14, 1992

[51] Int. Cl.[6] ..... G08B 25/00

[52] U.S. Cl. ..... 340/286.02; 379/37; 379/45; 379/48; 340/508

[58] Field of Search ..... 340/506; 379/37, 45, 379/48

[56] References Cited

U.S. PATENT DOCUMENTS

Re. 32,468 10/1982 Le Nay et al. ..... 340/506
4,347,501 8/1982 Akerberg ..... 340/506
4,356,475 10/1982 Neumann et al. ..... 340/506

*Primary Examiner*—Jeffrey A. Hofsass
*Assistant Examiner*—Daryl C. Pope
*Attorney, Agent, or Firm*—Michael B. Atlass; Robert B. Leonard

[57] ABSTRACT

An alarm system monitoring method for remote monitoring. A local alarm monitoring station receives alarm indications from alarms being monitored, and transfers the alarm indication to a first hub station. A load processor at the hub station, determines whether the first hub station should handle the call by comparing its current load of calls to a predetermined limit. If the limit is not crossed by local handling of the call, the first hub station will handle the call, and the load number is modified accordingly. If the first hub station cannot handle the new call, the call is transferred to a second hub station for processing.

7 Claims, 5 Drawing Sheets

SYSTEM AND METHOD FOR TRANSFERRING HUB ALARM SERVICE MONITORING

BACKGROUND OF THE INVENTION

The present application relates to alarm systems in general and more specifically to a system of remotely monitoring alarm systems.

In the past, there have been two primary ways of remotely monitoring alarm systems within a building. FIG. 1 shows one of the prior art systems and methods. Building 105 contains an alarm system 106 which then initiates communication with a local alarm monitoring station 115 via telephone line 110. Alarm system 106 is well known in the art and may be a Honeywell model 6000 alarm system.

Once an alarm indication has been received at the local monitoring station 115, a decoder 120 decodes the alarm indication and provides the information to computer 125. Computer 125 stores information such as the name of the owner of building 105, the address of building 105, and the appropriate fire or police agency to notify of the alarm condition. Thereafter, an operator (not shown) may call police station 135 via telephone 130. Handling of the alarm may be shifted to a Hub station 140 over transmission path 150 as shown in copending U.S. patent applications Ser. No. 07/1942696 and 07/942690, by Ballesty et al. and assigned to the assignee of the present application.

The second primary way of monitoring alarms is shown in FIG. 2. Please note that two separate cities, city A and city B, are shown but that city A and city B are identical in all relevant aspects. In the second scheme, alarm system **206*a*, which may be similar or identical to alarm system 106, produces an alarm across telephone line 210*a* to local monitoring station 215*a*. However, local monitoring station 215*a* does not contain any information on how to respond to an alarm indication. The local monitoring station merely receives alarm indications from an alarm unit and passes them to a hub station 230 via communication link 225*a* where record information on all monitored alarm systems was stored. This system provided the benefit for the owner of building 205*a* in that the telephone call from building 205*a* to alarm monitoring station 215*a* is a local phone call thus not requiring toll charges. Communications link 225*a*** may extend between distant cities and may require a long distance phone call.

A shortcoming of these systems is that regardless of the number of calls received at the hub station, all calls must be handled by that hub station.

SUMMARY OF THE INVENTION

The present invention is a system and method for transferring the processing of alarm indications from one hub station to another. The hub station includes a computer with a load processor such that the computer can receive alarm indications and shift relevant information to another hub station computer on an overload basis so that an operator at the other hub station may call an appropriate agency upon receipt of an alarm indication. The computer at the second hub station will then provide information back to the computer at the first hub monitoring station on what action was taken so that the computer storing record information may update its records. This computer might be the original local computer.

DETAILED DESCRIPTION OF THE PREFERRED EMBODIMENT

Figure 1:
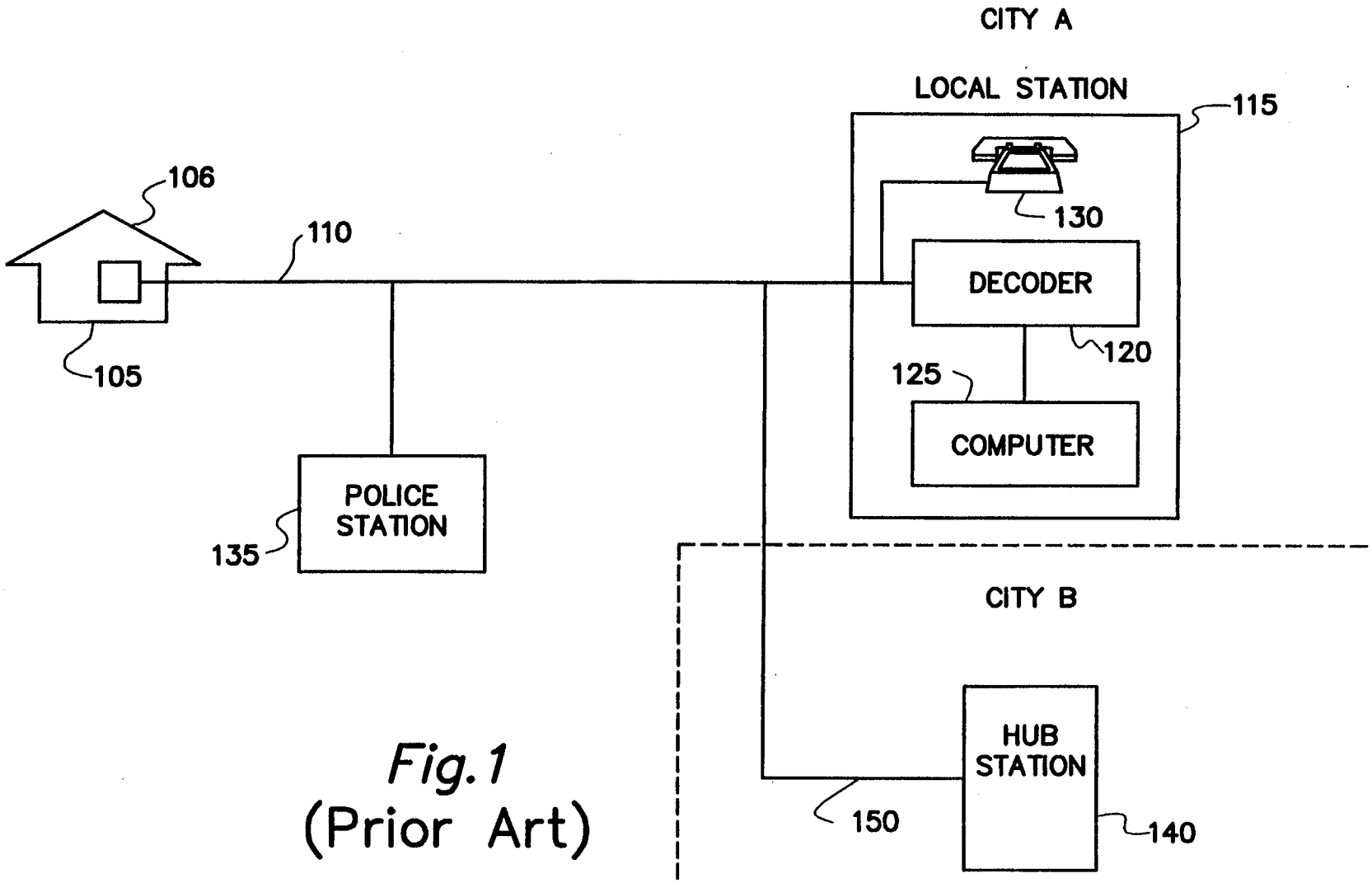
Fig. 1 (Prior Art)
FIG. 1 shows a first prior art system and method of remotely monitoring building alarm systems.
Figure 2:
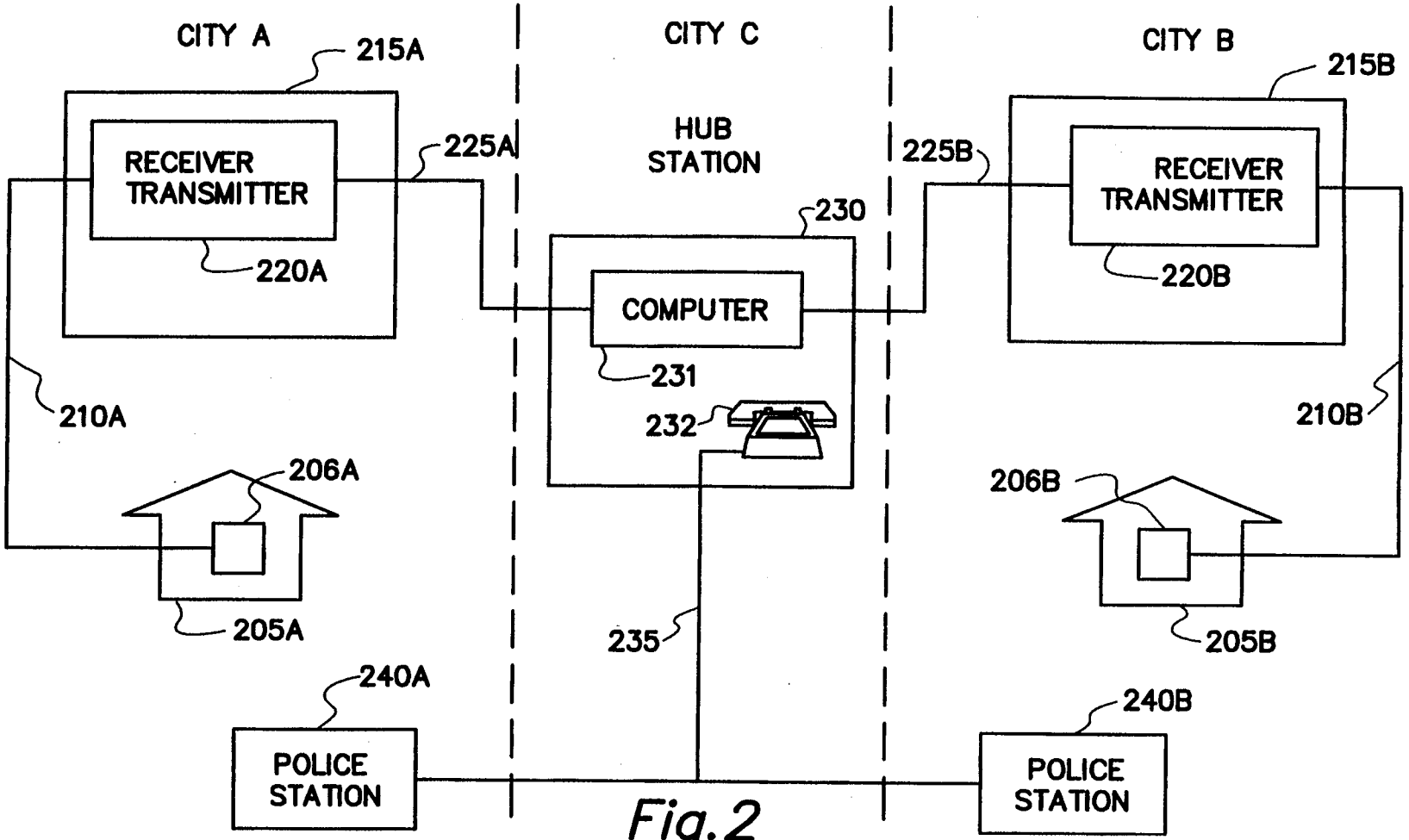
Fig. 2 (Prior Art)
FIG. 2 shows a second prior art system and method for remotely monitoring building alarm systems.
Figure 3:
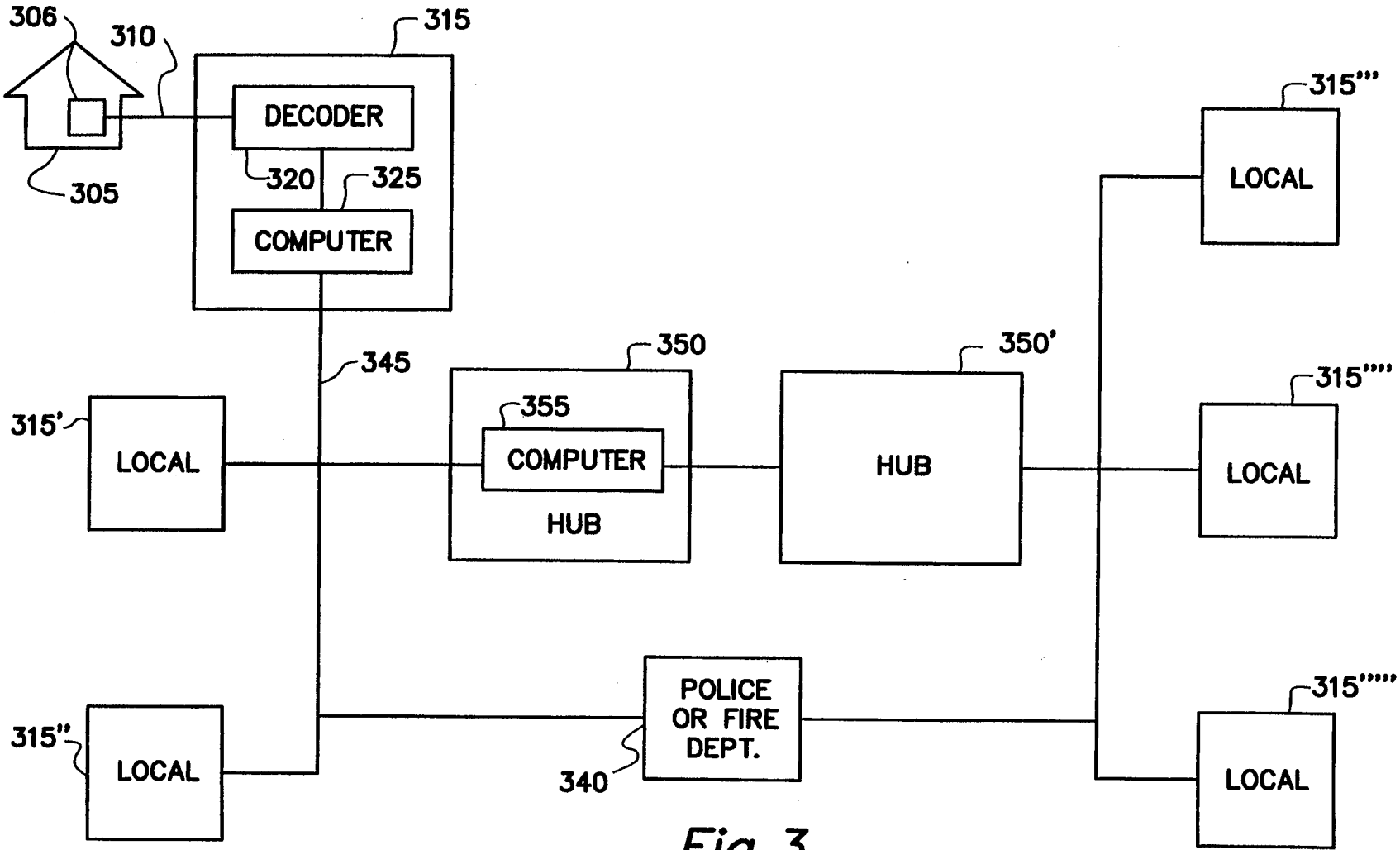
FIG. 3 shows a plurality of local stations connecting to a plurality of hub stations.

Referring now to FIG. 3, there shown is a preferred embodiment of the presently inventive system. Please note that the local alarm system of FIG. 1 is used in this embodiment, but that the local alarm system of FIG. 2 would work equally as well since the present invention resides in the hub stations. When an alarm event occurs in building 305, alarm system 306 generates an alarm signal. The alarm event could be an intrusion, fire, or system malfunction as examples. The alarm signal may indicate the type of alarm event. Then, transmission line 310 transmits the alarm signal (not shown) from building 305 to alarm monitoring station 315. Please note that the transmission line is used as an example only. RF links and other communication systems could be substituted for the transmission line.

At the alarm monitoring station 315, a decoder 320 decodes the alarm signal and passes the decoded signal to computer 325. Computer 325 then searches memory(not shown) for a record which matches the information contained in the decoded signal. A record may contain one or more of the following pieces of information: 1) building owner; 2) address; 3) phone number of building; 4) phone number of appropriate police agency; or 5) phone number of appropriate fire department. Once a matching record is found, the record information is sent via communication link 345, which may be a leased line, to computer 355 at Hub station 350. Hub station 350 may be connected to many alarm system stations 315, 315', and 315''. Packet switching technology may be used for transfer of the record information from the alarm monitoring station to Hub Station 350. Computer 355 (which is further described in connection with FIG. 4) will then display the record information for an operator (not shown) to contact the appropriate emergency agency 340 via phone 360.

If computer 325 is in "folddown" (not handling all calls) mode it sends the alarm to the hub computer 355 via communication link 345. When an operator at the hub station 350 selects this alarm to be processed, the hub computer sends a request with the alarm identification to the local computer 325 for supporting data to dispatch on the alarm. Computer 325 then searches its record memory (shown in FIG. 4) for a record which matches the information contained in the request from the hub station.

Once the operator has acted on a received alarm signal, the operator may input data into computer 355 which describes the action(s) taken by the operator. Computer 355 will then send the operator information back to computer 325 for modification of the appropriate record in computer 325.

Note that alarm monitoring station 315 may be set up so that it may also contact the emergency agency 340 directly. In this case, computer 325 would be configured to display record information and an operator would be stationed at alarm monitoring station 315 to handle alarm signals as they occurred.

Figure 4:
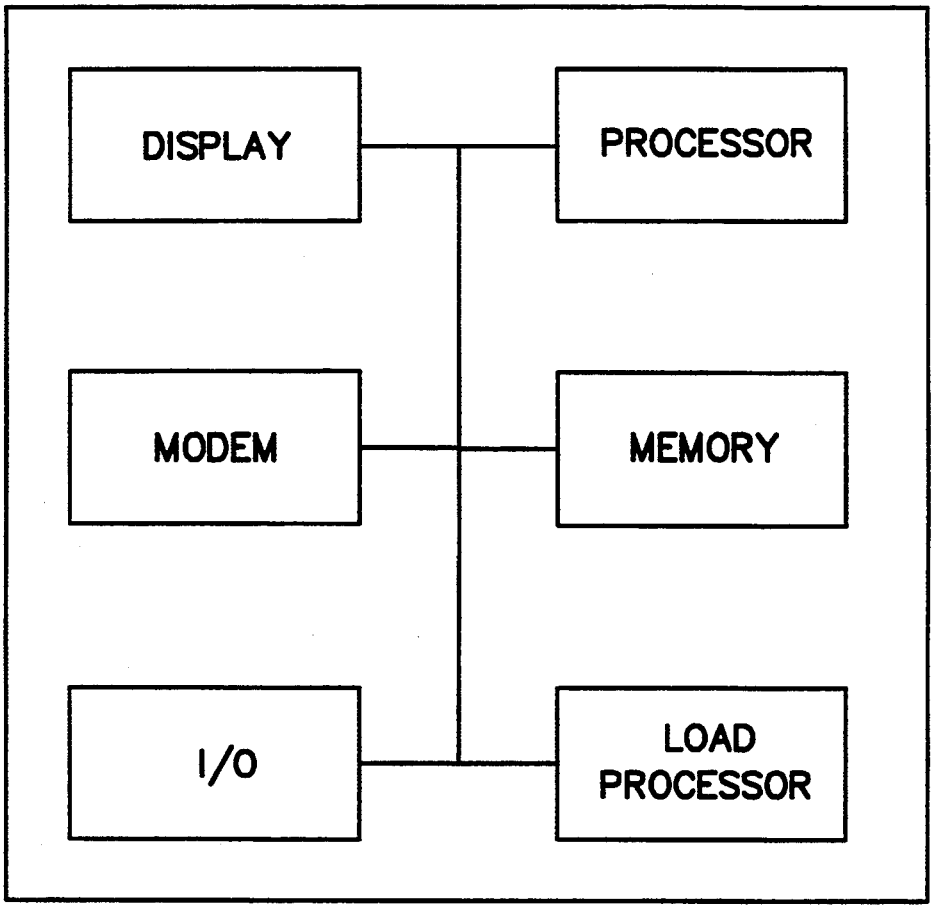
FIG. 4 shows the elements of the computer used at a hub monitoring station.

Referring now to FIG. 4, there shown is a block diagram of computer 355. The computer 355 shown in FIGS. 3 and 4 is used to run the Hub station operations. Computer 355 includes a display, a modem, a processor, record memory, memory, load processor and input-/output (I/O). The display is used for display of information relevant to records, and alarm system and computer operations. The modem may be used for communications to computer 325 and the computer 355' at another hub station. The processor receives instructions from memory (which stores operation information for the processor) and acts on signals received either from the I/O or the modem. Record memory stores record information relevant to alarm systems in buildings monitored by the alarm monitoring station. The I/O is a method of inputting and outputting information to and from the machine. The I/O may include a keyboard and serial and parallel data ports.

The load processor may be a standalone microprocessor or may be implemented in memory in the base processor unit. The load processor tracks a current number of calls being handled by the local station and compares this number to a preselected limit (AlarmMax). If the current number of calls is in a predetermined relationship to AlarmMax, such as greater than, then alarm calls are transferred from the local station to the Hub station for handling. Note that AlarmMax may be changed to recognize, for example, different staffing levels throughout a day or week. In addition, AlarmMax may at times be set equal to zero so that all calls are transferred to another Hub station.

Figure 5:
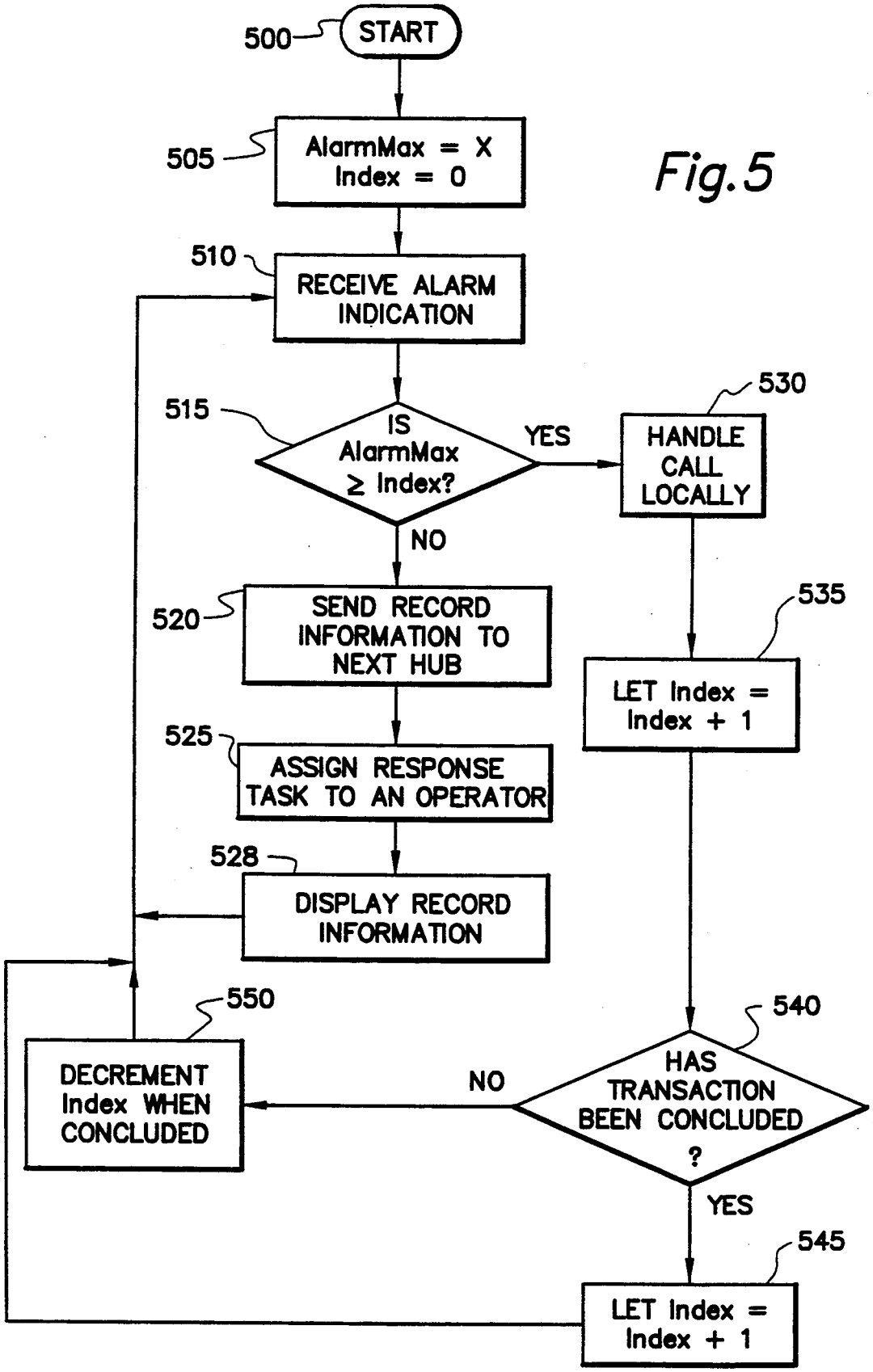
FIG. 5 shows a flow chart of the method used by the presently inventive system.

Referring now to FIG. 5, there shown is the method employed by the inventive system. After starting at block 500, the system sets the variable AlarmMax equal to X and the variable Index equal to zero at block 505. Next, at block 510, the system waits for receipt of an alarm indication. Then at block 515, the system determines whether AlarmMax and Index are in a predetermined relationship, here is AlarmMax less than or equal to Index. Note that other relationships are .possible within the spirit of the invention. If the predetermined relationship does not exist, the record information is sent to another hub as shown by block 520, where the response task is assigned and the record information is displayed according to blocks 525 and 528 respectively.

If the predetermined relationship does exist, the alarm indication is displayed at that alarm monitoring station and handled locally as shown in block 530 and the Index variable is incremented at block 535. The method then determines whether the particular transaction being handled has been terminated at block 540. If not, the method tracks the transaction until completed and decrements Index at that time, while still being able to receive alarm indications. If the transaction is completed at block 540, Index is immediately decremented and the process returns to block 510.

The foregoing has been a description of a system for monitoring building alarm systems. The inventors do not intend for the foregoing description to be limiting, but instead define the limits of their invention in the claims appended hereto.

We claim:

1. An alarm system monitoring system for monitoring a status of at least one alarm system at a remote site, comprising:

a local alarm monitoring station connected to said alarm system for monitoring the status of the alarm system;

a first hub alarm station connected to said local alarm monitoring station including a computer for comparing a current number of alarms being handled by said hub alarm station to a predetermined limit of alarms; and a second hub alarm station connected to said first hub alarm station, said first hub alarm station transferring alarm calls to said second hub alarm station if said current number of alarms is in a first relationship to said limit.

2. The apparatus of claim 1, wherein:

said "computer" increments said current number of "alarms" for each "alarm" handled by said first hub alarm station and decrement said current number of "alarms" for each "alarm" after it is completely processed by said computer.

3. A method for monitoring a status of at least one alarm system at a remote site, comprising the steps of:

setting a limit variable equal to a first predetermined number representative of a number of alarm indications to be computer processed at said first hub alarm station;

setting an index variable to a second predetermined number representative of a current number of alarm indications being computer processed at said first hub alarm station;

receiving an alarm indication at a local alarm monitoring station;

transferring said alarm indication to said first hub alarm station;

comparing said limit variable to said index variable and shifting responsibility for handling the alarm indication to a second hub station connected to said local alarm station if the limit variable and the index variable are in a first predetermined relationship, and having said local alarm monitoring station respond to said alarm indication otherwise.

4. The method of claim 3, comprising the further steps of:

modifying said index variable for every call to be responded to by a local alarm monitoring station; and modifying said index variable in an inverse relationship to said modification for every call to be handled which has finished being processed by said computer at said local alarm monitoring station.

5. The apparatus of claim 1, wherein the first relationship is defined as said current number of alarms being greater than said limit.

6. The apparatus of claim 1, wherein the first relationship is defined as said current number of alarms being less than said limit.

7. The apparatus of claim 1, wherein the first relationship is defined as said current number of alarms being equal to said limit.

* * * * *